US010483632B2

(12) United States Patent
El Hassani et al.

(10) Patent No.: US 10,483,632 B2
(45) Date of Patent: Nov. 19, 2019

(54) DEVICE FOR TRANSMITTING AND/OR RECEIVING RADIOFREQUENCY SIGNALS

(71) Applicant: INSIGHT SIP, Grasse (FR)

(72) Inventors: Chakib El Hassani, Villeneuve Loubet (FR); Christopher Barratt, Val d'Azur (FR)

(73) Assignee: INSIGHT SIP, Grasse (FR)

( * ) Notice: Subject to any disclaimer, the term of this patent is extended or adjusted under 35 U.S.C. 154(b) by 545 days.

(21) Appl. No.: 14/910,171

(22) PCT Filed: Jul. 31, 2014

(86) PCT No.: PCT/EP2014/066557
§ 371 (c)(1),
(2) Date: Feb. 4, 2016

(87) PCT Pub. No.: WO2015/018745
PCT Pub. Date: Feb. 12, 2015

(65) Prior Publication Data

US 2016/0172747 A1 Jun. 16, 2016

(30) Foreign Application Priority Data

Aug. 5, 2013 (FR) ..... 13 57782

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/243* (2013.01); *H01Q 1/48* (2013.01); *H01Q 9/0407* (2013.01); *H01Q 9/0421* (2013.01)

(58) Field of Classification Search
CPC ..... H01Q 1/38; H01Q 9/0407; H01Q 1/48; H01Q 1/243; H01Q 9/0421
See application file for complete search history.

(56) References Cited

U.S. PATENT DOCUMENTS 5,537,123 A 7/1996 Mandai et al.
6,218,991 B1 * 4/2001 Sanad ..... H01Q 1/36 343/700 MS
(Continued)

FOREIGN PATENT DOCUMENTS

| | | |
|---|---|---|
| EP | 1 933 416 | 6/2008 |
| EP | 2 267 834 | 12/2010 |
| WO | 2004051791 | 6/2004 |

OTHER PUBLICATIONS

J.-G. Gong, et al., "A Miniaturized Internal Wideband Antenna for Wireless USB Dongle Application," National Key Laboratory of Science and Technology on Antennas and Microwaves Xidian University Xi'an, Shaanxi 710071, China, 2010.
(Continued)

*Primary Examiner* — Hai V Tran
*Assistant Examiner* — Michael M Bouizza
(74) *Attorney, Agent, or Firm* — Hauptman Ham, LLP

(57) ABSTRACT

Apparatus for transmitting and/or receiving radiofrequency signals comprising at least a broadband antenna (310) and a substrate (410); the antenna (310) comprising at least a first radiating surface (318) and being superimposed on the ground plane, the ground plane being located on a first face of the substrate (410), at least a side tongue of power supply (314) and at least a side wall (316) connected to at least the first radiating surface (318), the apparatus being characterized in that the side wall (316) is connected to a coupling trace (416) located on a second face of the substrate (410), opposite to the first face of the substrate (410), and the side wall (316) and the coupling trace (416) being configured to act as a capacitive coupling between at least the first radiating surface (318) and the ground plane.

18 Claims, 11 Drawing Sheets

(51) Int. Cl.
*H01Q 1/48* (2006.01)
*H01Q 9/04* (2006.01)

(56) References Cited

U.S. PATENT DOCUMENTS

| | | | | |
|---|---|---|---|---|
| 7,696,927 | B2 | 4/2010 | Bae et al. | |
| 2002/0163471 | A1* | 11/2002 | Lopez | H01Q 1/243 343/702 |
| 2007/0139277 | A1* | 6/2007 | Nissinen | H01Q 1/243 343/700 MS |
| 2008/0036668 | A1* | 2/2008 | White | H01Q 1/20 343/745 |
| 2008/0143608 | A1 | 6/2008 | Watanabe et al. | |
| 2008/0291111 | A1 | 11/2008 | Bae et al. | |
| 2011/0109515 | A1* | 5/2011 | Rao | H01Q 1/243 343/702 |

OTHER PUBLICATIONS

J. Xu, et al., "A Small UWB Antenna with Dual Band-Notched Characteristics," Hindawi Publishing Corporation International Journal of Antennas and Propagation vol. 2012, Article ID 656858, 2012.

C. Y. Wu, et al., "Compact Surface-mount UWB Monopole Antenna for Mobile Applications," Industrial Technology Research Institute, Taiwan, Progress in Electromagnetics Research Symposium 2006, Cambridge, USA, Mar. 2006.

Sang-Hyuk Wi, et al., "Integration of Antenna in IC Package for UWB Single-chip Radios," 1Dept. of Electrical and Electronic Engineering, Yonsei University, Seoul, Korea, International Symposium on Antennas and Propagation—ISAP 2006.

David Kearney, et al., "Miniature Ceramic Dual-PIFA Antenna to Support Band Group 1 UWB Functionality in Mobile Handset," IEEE Transactions on Antennas and Propagation, vol. 59, No. 1, Jan. 2011.

H. T. Chattha, et al., "Band-Notched Ultrawide Band Planar Inverted-F Antenna," Hindawi Publishing Corporation International Journal of Antennas and Propagation vol. 2012, Article ID 513829, 6 pages, 2012.

Cheolbok Kim (2010). "Ultra-Wideband Antenna," Microwave and Millimeter Wave Technologies Modern UWB antennas and equipment, Igor Mini (Ed.), ISBN: 978-953-7619-67-1, InTech, <http://www.intechopen.com/books/microwave-and-millimeter-wave-technologies-modern-uwb-antennas-andequipment/ultra-wideband-antenna>, 2010.

* cited by examiner

Prior Art

DEVICE FOR TRANSMITTING AND/OR RECEIVING RADIOFREQUENCY SIGNALS

TECHNICAL FIELD

The present invention relates generally to the field of antenna and more particularly the miniature antennas utilized by all kinds of portable and mobile electronic devices to receive and transmit signals, typically in a range of frequencies currently up to around ten gigahertz (Ghz=$10^9$ Hertz), so they can communicate freely in a geographical area covered by a network called "cordless" or even "wireless", a widely used expression having the same meaning.

BACKGROUND

The so called "wireless" communicating systems which are more and more used daily and often of quasi permanent manner by an always increasing user population, all have antennas for receiving and more often for transmitting signals in the frequency band defined by the standard technology that regulates them. It mainly concerns mobile phones, particularly those based on the standard called GSM, standing for "global system for mobile communications", which defines a communication standard that has worldwide geographical coverage.

Another very widely used communicating system, which requires a very sensible receiving antenna is the GPS, standing for "global positioning system". By decoding signals from satellite network, this system in fact makes it possible to obtain, all over the terrestrial globe, a very precise geographic positioning of the receiver. GPS receivers are more often found in the mobile phones and in all kinds of so-called "smart phones" that also include all the functions of a personal digital assistant (PDA) and the ability to connect to the worldwide network of the Internet.

The wireless network may instead be conceived to only cover a limited geographic area, or even very limited as the so-called standard "Bluetooth" which allows communication up to around ten meters of terminals between them. Another very widely used communication standard of bigger range is the one called "Wifi" which allows to create a wireless local network or LAN, standing for "local area network", in a limited geographic zone, frequently visited by the public: a building, the premises of the government or of a company, a café etc.

In spite of their miniaturization needed to fit the dimensional constraints imposed by the always smaller housings, especially when the thickness becomes very small, the antennas of the above devices have to be nevertheless able to maintain a maximum efficiency throughout the frequency bands where they are operated. Such efficiency depends on losses which are inherent to the antenna and which are most commonly measured using parameters called "S", "scattering parameters" that enables qualifying the behavior of the antenna between the propagating medium on the one hand and the electronic control circuit on the other hand. Generally speaking the parameters S have been conceived and used to measure and qualify the behavior of linear passive or active circuits operating in the frequency range mentioned above often referred to as hyper frequencies (microwaves) or radio frequencies in the technical literature of these matters. It allows estimating the electrical properties of these circuits such as their gain, the loss in yield where the voltage standing wave ratio resulting from an impedance mismatch observed between the control circuit and the antenna. The matching of the antenna is particularly defined by the parameter S11 representing the reflection loss of the antenna. It is expressed in decibels (dB). The lower the value of S11 is the better the matching and thus the overall efficiency of the antenna.

The parameter S11, which is frequency dependent, allows defining the bandwidth of the antenna, that is, the frequency band in which S11 remains less than a given threshold, which is typically defined at a level of −6 dB. Under these conditions, one quarter of the power delivered by the control electronic circuit is lost by reflection, and three quarters are thus usefully radiated by the antenna.

The bandwidth of an antenna can be more or less wide. It is often expressed in percentage of its central frequency. An antenna whose bandwidth is of a few percentages is considered to have a narrow operating band. This type of antenna is suitable for certain applications. For example, for a GPS receiver, an antenna whose bandwidth is of the order of 2% is sufficient.

An antenna whose bandwidth is equal or larger than 15% is considered to have a wide operating band. Those whose bandwidth are larger than or equal to 20% have a very wide bandwidth. It is to be noted here that to describe this type of antenna, the acronym of "UWB", "ultra-wide band" is also often used.

The use of a very wide band antenna potentially offers many advantages. A single broadband antenna can thus simultaneously cover multiple radiofrequency standards. This reduces the number of antennas that has to be implanted in the multiservice wireless devices such as the smart phones, which not only gives an advantage in terms of cost but also makes it possible to overcome technical problems otherwise difficult to solve such as parasite couplings that may occur between the different antennas of the same smart phone.

Furthermore, the development of applications requiring to be able to download and transmit always larger quantity of data, notably the transmission of video signals, led the standardization bodies to define communication protocols offering wider and wider bandwidths. For example, in 2002 frequency bands ranging from 3.1 to 10.6 GHz to so-called UWB standard were allocated (in the form of six groups representing fourteen frequency bands, with 528 MHz of width each), for short-distance communications of WiFi type. The emergence of UWB-based communication applications is remarkable, which contributed to highlight the need for very wide band antenna solutions, which should be readily industrialized, inexpensive and easy to integrate.

However, the realization of broadband miniature antennas faces considerable theoretical and technical problems. It is particularly well known that obtaining small-sized antennas in view of the wavelengths to be transmitted can only be done at the price of dramatically reducing their bandwidth, which goes directly against the purpose.

It is therefore an object of the invention to provide a solution to this problem by reducing the size of the antenna intended to be implanted in the same housing while their control circuit can still maintain sufficiently wide bandwidth for operating.

Other objects, features and advantages of the present invention will appear when studying the following description and accompanying drawings. It is understood that other advantages may be incorporated.

SUMMARY

The invention relates to an apparatus for transmitting and/or receiving radiofrequency signals comprising at least a broadband antenna and a substrate; the antenna comprising at least a first radiating surface and being superimposed on the ground plane, the ground plane being located on a first face of the substrate, at least a side tongue of power supply and at least a side wall connected to at least the first radiating surface. The antenna comprises at least a second radiating surface configured to be excited by coupling with the first radiating surface, the side wall is connected to a coupling trace located on a second face of the substrate, opposite to the first face of the substrate, and the side wall and the coupling trace being configured to act as a capacitive coupling between at least the first radiating surface, possibly the second radiating surface and the ground plane.

The invention also relates to a method for manufacturing an apparatus for transmitting and/or receiving radiofrequency signals comprising at least a broadband antenna and a substrate, the antenna comprising at least a first radiating surface and being superimposed on the ground plane, the ground plane being located on a first face of the substrate, comprising a step of forming the antenna, a step of installing the antenna on the substrate. The step of forming the antenna is advantageously performed so that the antenna comprises at least a second radiating surface configured to be excited by coupling with the first radiating surface. The step of installing the antenna is performed so that the side wall is connected to a coupling trace located on a second face of the substrate, opposite to the first face of the substrate, and the side wall and the coupling trace being configured to act as a capacitive coupling between at least the first radiating surface and the ground plane.

The antenna of the invention is designed to operate above a ground plane to allow high freedom of placement on the application card that uses it and avoid any additional constraint to its designer. The major difficulty is that the proximity of a ground plane may render the antenna resonant and inefficient, this difficulty is overcome by the described structure. Moreover, the cost of implementation of the antenna which comprises the materials used, its manufacture and assembly is still low compared to the overall cost of the radio frequency module that is used.

The antenna according to the present invention allows operation of the antenna broadband made possible by the coupling of several resonances.

BRIEF DESCRIPTION OF THE DRAWINGS

The purpose, objects as well as the features and advantages of the invention will be made more evident in the detailed description of an embodiment thereof, which are demonstrated by the following accompanying drawings, wherein.

Figure 1A:
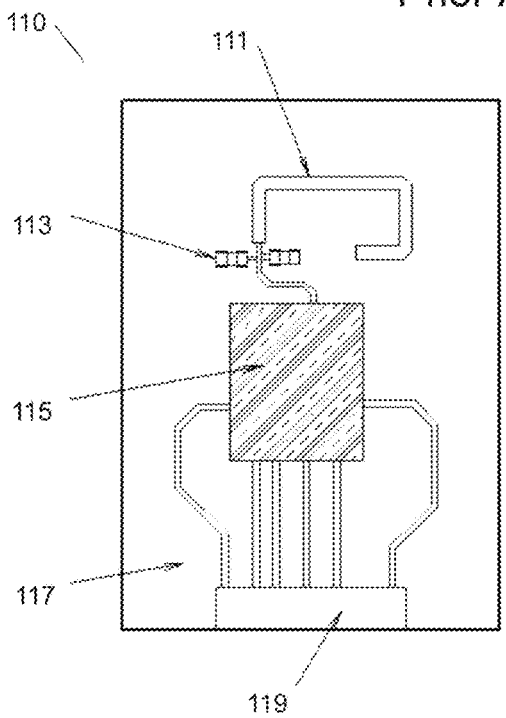
FIGS. 1*a*, 1*b* and 1*c* illustrate conventional implantations of miniature antennas.

The accompanying drawings are given as examples and are not limitation of the invention.

DETAILED DESCRIPTION

Before starting to review the detailed embodiments of the invention, it is set below optional features that may be used following any combination or alternatively: The coupling trace 416 is configured to form a coupling capacitor whose value is $\varepsilon S/e$ where $\varepsilon$ is the dielectric constant of the dielectric material constituting the substrate 410, S is the surface of the coupling trace 416 and e is the thickness between the coupling trace 416 located on the second face of the substrate 410 and the ground plane located on the first face of the substrate 410.

- The antenna 310 is configured to generate at least a first resonance along a length dimension 820 of the first radiating surface 318 and at least a second resonance along a width dimension 810 of the first radiating surface 318.
- The side wall 316 comprises at least a first portion in a plan parallel to the thickness of the substrate 410 and along a width dimension 810 of the first radiating surface 318.
- The side wall 316 comprises at least a second portion in a plane parallel to the thickness of the substrate 410 and along a length dimension 820 of the first radiating surface 318.
- The first portion and the second portion of the side wall 316 are configured to be in electrical contact and are fixed onto the coupling trace 416.
- The antenna 310 comprises at least a second radiating surface 312 configured to be excited by coupling with the first radiating surface 318.
- antenna 310 is configured to generate a third resonance along a length dimension 1210 of the second radiating surface 312.
- The first radiating surface 318 has a length dimension 820 larger than the length dimension 1210 of the second radiating surface 312.
- The first radiating surface 318 and the second radiating surface 312 are of rectangular or polygonal shape.
- At least the first radiating surface 318 forms an L with a first side of the L extending along the length 820 of the first radiating surface 318 and a second side of the L extending along the width 810 of the first radiating surface 318.

The second radiating surface 312 is a homothety of the first radiating surface 318 of smaller dimension.

The side tongue of power supply 314 is configured to be in contact with a power supply trace 414 located on the second face of the substrate 410.

The antenna 310 forms a cavity for accommodating at least a chip 412 between at least the first radiating surface 318 and the second face of the substrate 410.

The power supply trace 414 is connected to a connection 413 of the chip 412.

The method comprises the step of forming the antenna 310 comprising a step of cutting a metal plate followed by a step of folding the metal plate.

The method comprise at the end of the step of installing the antenna, a step of overmolding 610 configured to coat at least the antenna 310.

The method comprises prior to the step of installing the antenna 310, a step of overmolding 610 at least a chip 412 present on the second face of the substrate 410.

The method comprises at the end of the step of overmolding 610, a step of depositing a metal layer is performed, followed by a step of etching said metal layer so as to form the antenna 310.

The concept of housing antenna or AIP, standing for "antenna in package", includes all the solutions that allow implanting in the component: the radiofrequency chip for transmitting and receiving radiofrequency signals; the antenna and its matching network as well as other radiofrequency components. Typical examples of integrating an antenna within a same electronic module are shown in FIGS. 1*a*, 1*b* and 1*c*.

The main advantages of the AIP solutions, in addition to saving significant surface compared to an external antenna, lies in the fact that the matching between the radiofrequency chip and its antenna is thus implemented once and for all even during the designing of the module by a highly qualified specialized staff. As shown in FIG. 1*a*, in a conventional solution where the antenna 111 is formed on a printed circuit 110 or PCB, that is "printed circuit board" supporting the radiofrequency chip 115, the performances are then directly dependent on the features of the application PCB, which involves the intervention of a qualified staff in radiofrequency during the integration phase. In fact, what has to be conceived simultaneously during this phase is not only the conventional placing of the radiofrequency chip and its interconnection 117 towards the outside world through a connector 119 but also, what is much more troublesome due to very high frequency of transmitting and receiving, the interconnection with the antenna and its matching 113 so that it can radiate and receive radiofrequency signals with all the necessary efficiency.

Figure 1B:
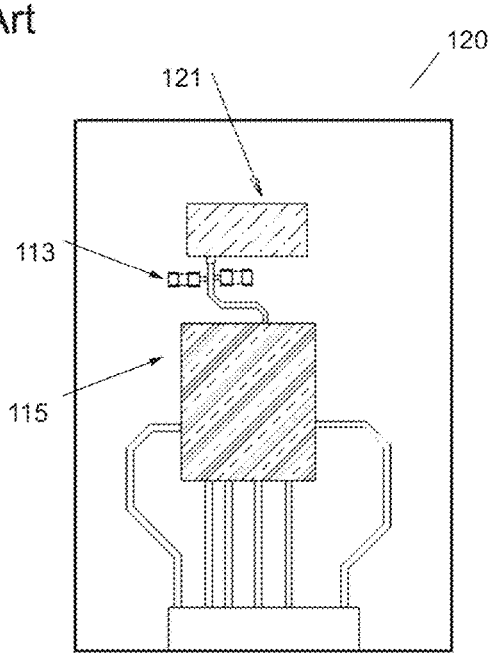

FIG. 1*b* illustrates the case where the antenna itself is placed on a separated component 121 to facilitate the integration of the radiofrequency solutions. It then concerns typically a ceramic module which is itself soldered on the PCB. To carry out the matching 113 between the antenna 113 and the radiofrequency chip 115, the intervention of a specialized staff is however required.

Figure 1C:
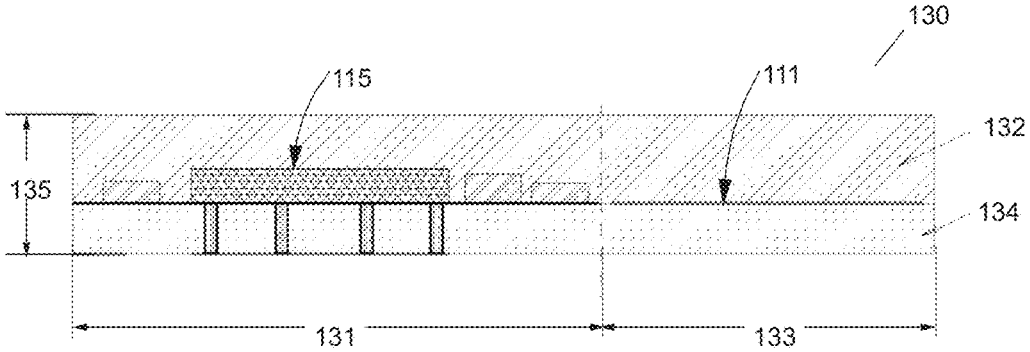

FIG. 1*c* illustrates the fact that most commonly in the conventional solutions, radiofrequency chip and antenna occupy separate surfaces, 131 and 133, which do not overlap. This is done by extending the substrate 134 constituting the PCB. The good radiation of the antenna 111 indeed usually imposes the total absence of all metal surface in view of which may make shield. This is particularly the case of the ground plane which is always present in the area 131 of PCB receiving the electronic components and particularly the radiofrequency chip 115.

It is to be noted and already here that in the solutions where extending the substrate 134 is performed to receive the antenna 111, the total surface of module 110 should then be increased by the occupied surface by the latter. However, the advantage is that the thickness 135 of the module, after coating in a layer called overmolding 132, can then stay more easily compatible with the constraints of thickness imposed by the manufacturers of communicating apparatus whose offer emphasizes on the products of tablet type which should be extremely thin to be commercially competitive.

Figure 2:
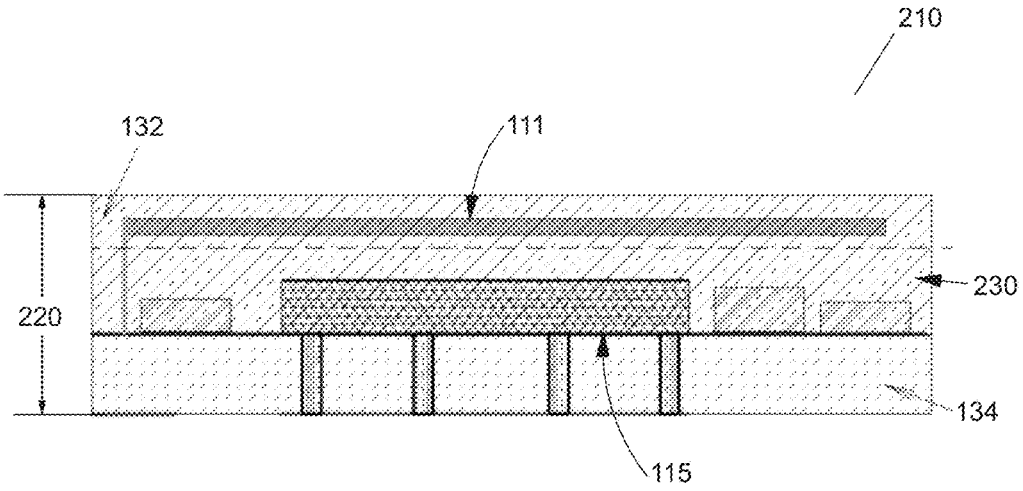
FIG. 2 illustrates the objective of the invention where the antenna is placed over a control radiofrequency chip.

However, due to the trend that has continued over decades which applies to all the components produced by the microelectronic industry to have to always reduce the size of these components, considerations have now to be given to overlay at least one antenna 111 and at least one radiofrequency chip 115 in order to obtain a supplementary reduction of horizontal dimensions while maintaining the efficiency in transmitting and receiving of the antenna. This is shown in FIG. 2 which illustrates the objectives where it is desired to place the antenna 111 over the radiofrequency chip 115 despite the fact that this part comprises a ground plane. The supplementary constraint imposed on this approach being that the thickness of the ensemble 220 should not be substantially greater than in the case illustrated in FIG. 1*c* where the antenna 111 is placed on an extension of the substrate 134. This is so that the radiofrequency chip 115 can always be integrated in the communicating devices of tablet type with small thickness.

If UWB antennas which can be placed over a ground plane have been described in the specialized technical literature, they are yet not suitable. For example, in the publication "IEEE TRANSACTION ON ANTENNA AND PROPOGATION, VOL. 59, NO. 1", published in January of 2011, the article entitled "Miniature Ceramic Dual-PIFA Antenna to Support Band Group 1 UWB Functionality in Mobile Handset" can be found. If the authors describe well an antenna whose performance is not significantly affected by the presence of other components located in proximity, it remains that the dimensions of this antenna is not at all compatible with the objectives of the invention. In particular, its thickness is six millimeters (mm), which is far too high while the desired thickness of the overall 220 including: the substrate 134, the overmolding area 132 of the antenna 111 and that of the radiofrequency components 230 of a communicating module 210 according to the invention, is advantageously in the order of millimeter and should not exceed two millimeters.

The same comment applies to another article describing an UWB antenna published in "International Journal of Antennas and Propagation, Volume 2012, Article ID 513829" with the title "Band-Notched Ultrawide Band Planar Inverted-F Antenna". Again the thickness of the described antenna is far too high (4.5 mm) to meet the objectives of the invention.

The antenna described in the following drawings meets the objectives of the invention and is thus capable of transmitting and receiving signals in all the frequency range of UWB standard while maintaining reduced dimensions particularly in thickness.

Figure 3:
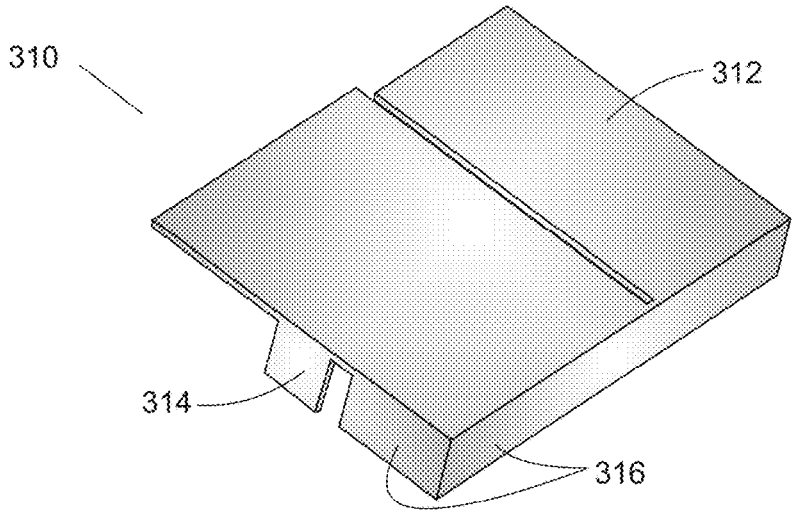
FIG. 3 shows an example of antenna according to the invention intended to lay on a multi-layer substrate comprising a radiofrequency chip.

As shown in FIG. 3, the antenna 310 according to the invention aims to rest on a multilayer substrate 410 with which it will interact.

Figure 4:
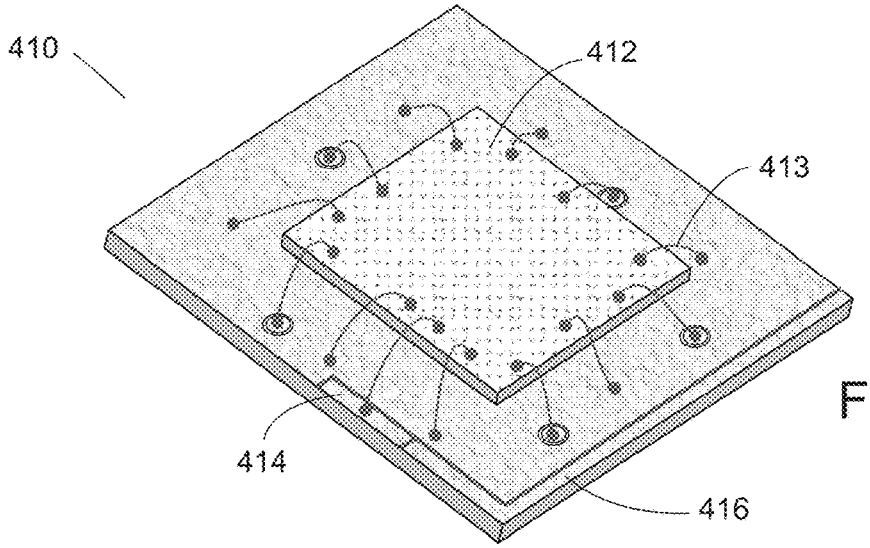
FIG. 4 shows an example of the substrate and of the RF chip.

An example of such a substrate 410 is shown in FIG. 4 which supports typically at least a radiofrequency chip 412 from which the signals to be transmitted are generated to be radiated via the antenna 310. Obviously another function of it is to collect the signals transmitted by other antennas being amplified by the radiofrequency chip 412 to be utilized by a receiving system. It should be noted that in general the substrate 410 supports more than one component. In addition to the radiofrequency chip 412, it is common that substrate 410 comprises also matching radiofrequency components like those mentioned in FIGS. 1*a* to 1*c* (not shown in FIG. 4). In the example of FIG. 4, the interconnections 413 between the radiofrequency chip 412 and the substrate 410 are done by using a very commonly used technique in microelectronic called "wire bonding" based on usage of gold wire. In this case, the radiofrequency chip 412 is typically fixed on the substrate 410 by bonding or soldering. Other interconnection and assembling techniques well known for persons skilled in the art can be used without inconvenience for implementing the invention.

With regard to the antenna 310 shown in FIG. 3 it comprises the following elements:

At least a first radiating surface 318 called "patch". This term is very commonly used in this field to refer to a typically flat cut-surface in a metallic structure as in the example of FIG. 3.

A side tongue of power supply 314 of the antenna 310 also serving to receive radiofrequency signals captured by it. The side tongue of power supply 314 is configured to be in contact with a power supply trace 414 located on the second face of the substrate 410. Particularly advantageously, the power supply trace 414 is connected to a connection 413 of the chip 412.

A side wall 316 in the shape of an L connected to the first radiating surface 318 and which via the coupling trace 416 acts as capacitive coupling between the antenna 310 and particularly the first radiating surface 318 and the ground plane shown in FIG. 4. The side wall 316 comprises at least a first portion in the plane parallel to the thickness of the substrate 410 and along a width dimension 810 of the first radiating surface 318. The side wall 316 comprises at least a second portion in the plane parallel to the thickness of the substrate 410 and along a length dimension 820 of the first radiating surface 318. The first portion and the second portion of the side wall 316 are configured to be in electrical contact and are fixed by soldering on the coupling trace 416.

Figure 5:
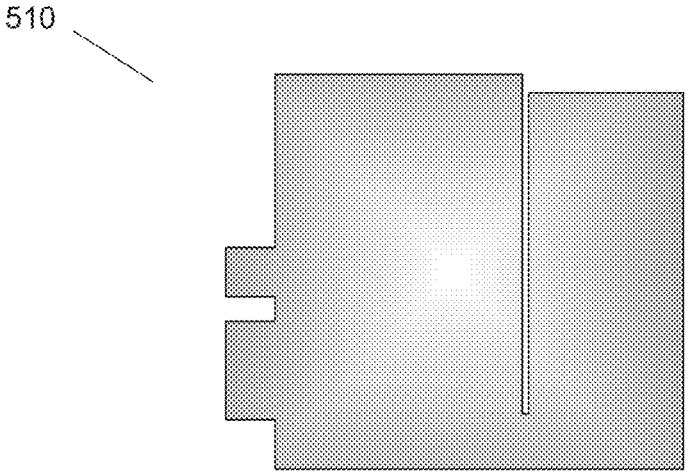
FIG. 5 illustrates the cutting that has to be performed in a metal strip for obtaining the antenna after folding.

Typically, the antenna 310 can be formed from a metallic plate (for example, a copper metal strip) in which cuttings are performed to obtain the appropriate shape 510 illustrated by FIG. 5. Next, by using a bending tool the desired three-dimensional structure as shown in FIG. 3 is achieved. The cutting and folding of thin metal parts are widely used by the industry of electronic, for example for manufacturing integrated circuit carriers or for realizing shielding housings. These techniques are inexpensive and compatible with mass production. It should be noted that here for mechanical stability reasons, during the assembly, additional legs (not shown) can be achieved during the cutting. These legs, which are neither connected nor coupled to any metal layer of the substrate 410, do not disturb the operation of the antenna 310. Their role is limited only to guarantee a mechanical support of the latter during the assembly.

It should also be noted that numerous other means of embodiments as described above, commonly implemented by the microelectronic industry can also be well used to achieve the antenna according to the invention. It concerns particularly techniques well known by persons skilled in the art which are based on the use of chemical etchings or metallization of plastic housings.

Figure 6:
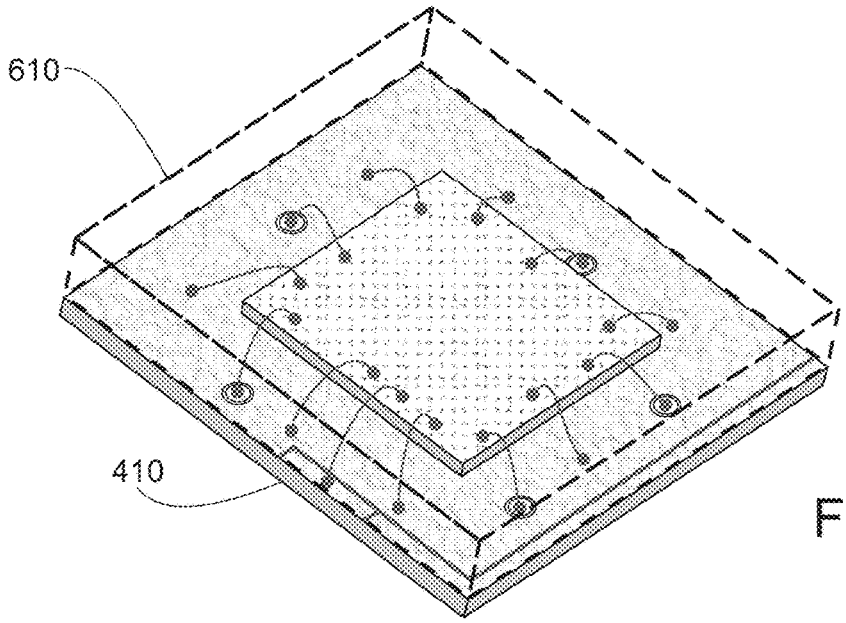
FIG. 6 illustrates a possible embodiment where prior to the installation of the antenna, overmolding 610 the components present on the substrate is performed.

FIG. 6 illustrates a possible embodiment during which it is performed at the end of the installation of the antenna 310, an overmolding 610 of components and connection means present on the second face of the substrate 410 for protecting them. The coating or overmolding of the components (and particularly of at least the antenna 310 and at least a radiofrequency chip 412) present on the second face of the substrate 410 is a commonly practiced operation for which is used for coating products which provides all the guarantees of safety and stability over time with regards to the components that they coat.

Figure 7:
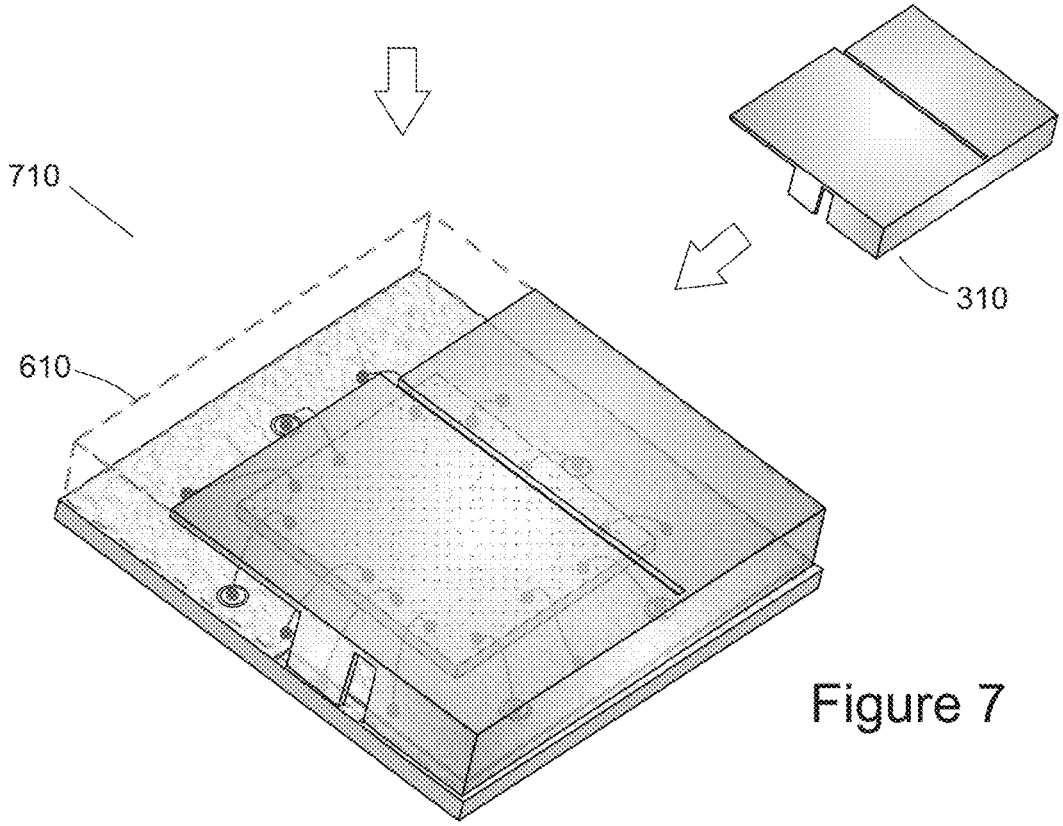
FIG. 7 illustrates the installation of the antenna possibly after coating components.

FIG. 7 illustrates the installation of the antenna 310 which ensures its antenna role possibly after coating. The overmolding of components is an optional but useful operation which does not have impact on the electrical performance of the system. The antenna 310 can optionally play alone the role of protection of components mounted on the substrate 410 and of the interconnections 413. Advantageously, the overmolding brings a mechanical rigidity and a ting particles proof protection. Particularly advantageously, the antenna 310 is located over the ground plane. The antenna 310 form preferably a cavity that allows accommodating at least a chip 412 between at least the first radiating surface 318 and said ground plane. The step of installing the antenna 310 is performed so that the side wall 316 is connected to the coupling trace 416.

Another possible embodiment which is not illustrated in the drawings involves etching the antenna 310 directly on the overmolding 610. In this option, the overmolding 610 is necessarily present. After being formed, it is covered of a metallic layer that is etched for example chemically (depositing, spraying), to create the different elements of the obtained antenna 310, for example from a metallic strip.

Figure 8:
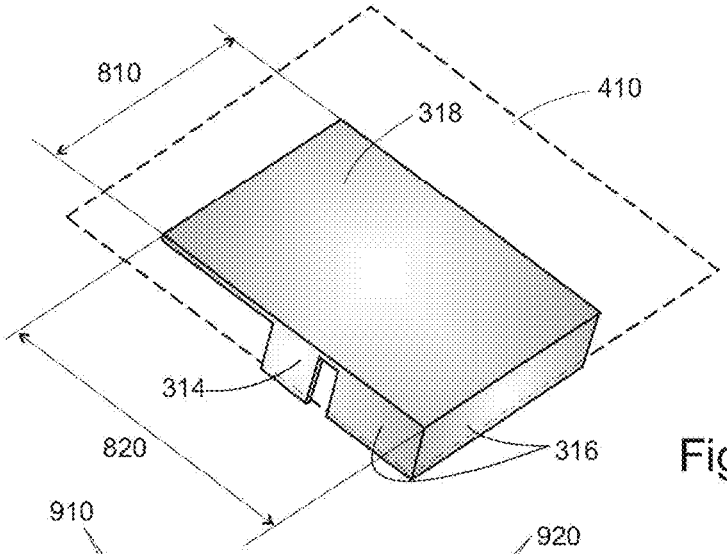
FIG. 8 describes the first radiating surface of the antenna.

FIG. 8 and the following illustrate the operation of the antenna 310. The principle of an antenna according to the invention advantageously involves generating several resonances by ensuring that they are sufficiently coupled so their proximity can be used to obtain broadband antenna 310. The steps of designing the antenna are described below.

Figure 9A:
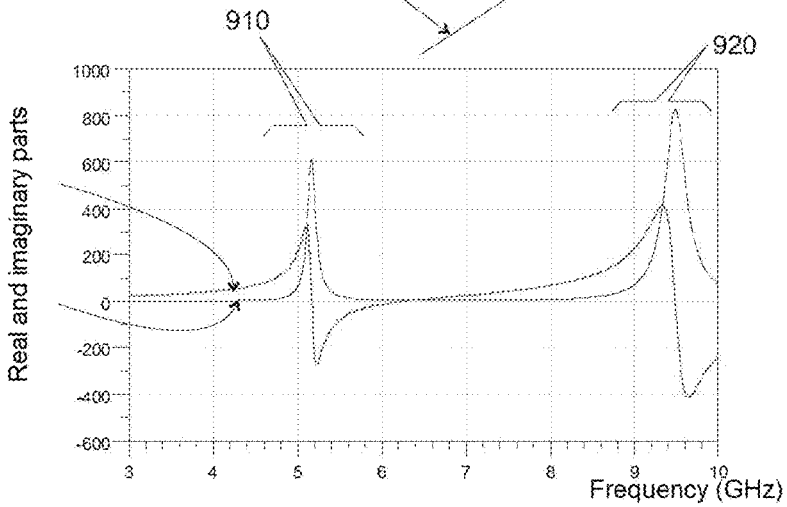
FIGS. 9*a* and 9*b* illustrate the operation of the first radiating surface.
Figure 9B:
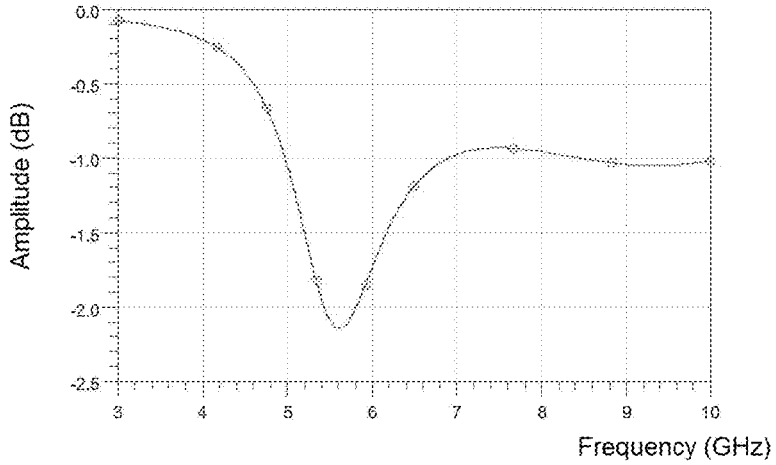

As shown in FIG. 8, in a first step, a first radiating surface 318 is defined, for example of rectangular shape, which will constitute the main radiating element of the antenna 310. The first radiating surface 318 is excited, as already seen via the side tongue of power supply 314 located on one side of it. Moreover as also seen, this first radiating surface 318 is mechanically supported by the side wall 316 in L shape. In a standard implantation, the first radiating surface 318 is connected, via the side wall 316 to the ground plane of the substrate 410, said ground plane being located on a first face of the substrate 410, opposite to the second face of the substrate 410. According to one embodiment, the ground plane is a bottom layer in the case where the substrate 410 is multilayer. This structure constitutes a type of antenna that is widely used called PIFA, standing for "planar inverted F antenna". This structure allows generating a double resonance shown in FIG. 9*a*. The wavelength corresponding to the frequency of the antenna being conventionally called as $\lambda$, the lowest resonance frequency 910 is based on one mode of resonance corresponding to one quarter of the wavelength or $\lambda/4$, along the largest dimension of the first radiating surface 318, that is to say its length 820. The highest resonance frequency 920 in a similar way corresponds to the width of the antenna 310. As shown in FIGS. 9*a* and 9*b*, the two modes are not properly coupled.

In the following examples, the antenna 310 is optimized to operate in the 7-9 GHz band which corresponds to Group 6 of the UWB standard.

Figure 10:
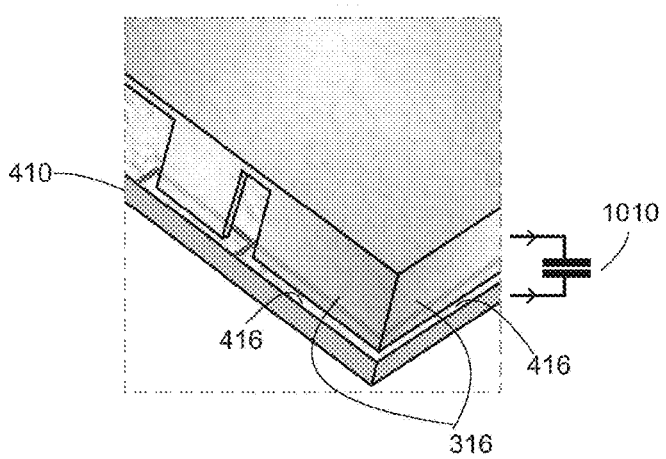
FIG. 10 shows the capacitive coupling established between the antenna and the ground plane of the substrate.
Figure 11A:
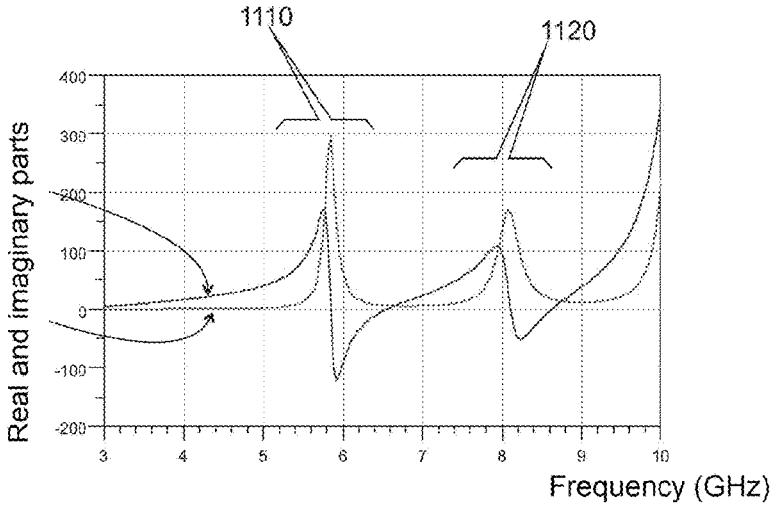
FIGS. 11*a* and 11*b* illustrate the operation of the antenna with capacitive coupling.
Figure 11B:
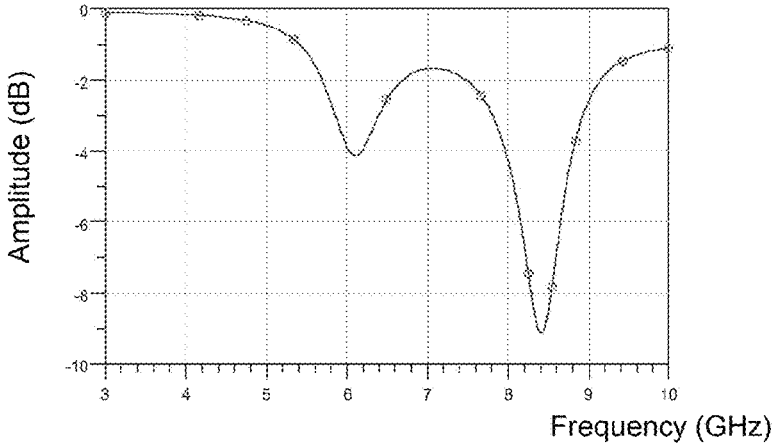

FIGS. 10, 11*a* and 11*b* illustrate a second step of the invention, which involves improving the matching and bringing closer the two resonances of the first radiating surface 318 in order to obtain a better coupling between the two modes of resonance. Here the invention applies a new approach, which involves replacing the electrical connection between the side wall 316 of the antenna 310 and the ground plane of the substrate 410 by a capacitive coupling 1010 with the latter. Thus the side wall 316 is connected in this case as already shown in FIG. 4 to a metallic coupling trace 416 located on the second face of the substrate 410 but disconnected from the ground plane; said ground plane being located on the first face of the substrate 410. This coupling trace 416 forms a coupling capacitor whose value is εS/e where ε is the dielectric constant of the dielectric material constituting the substrate 410, S is the surface of the coupling trace 416 and e is the thickness between the coupling trace 416 located on the second face of the substrate 410 and the ground plane located on the first face of the substrate 410. As shown in FIGS. 11*a* and 11*b*, the two resonances 1110 and 1120 are thus closer and a better impedance matching is observed.

Figure 12:
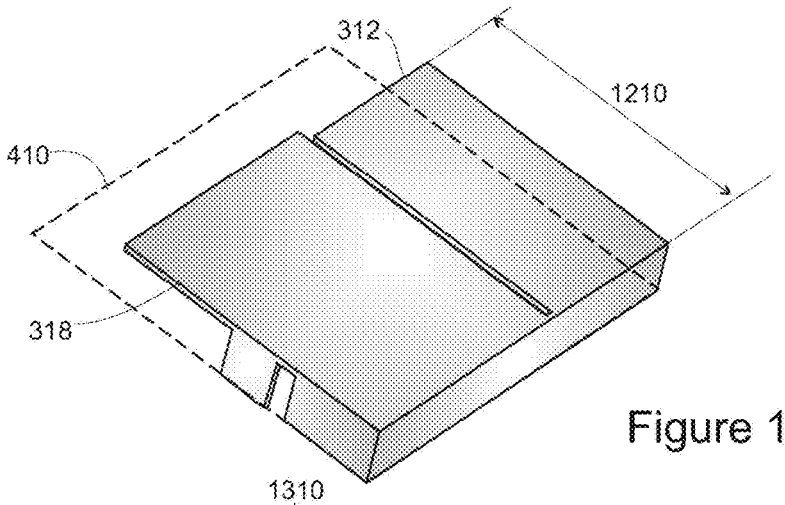
FIG. 12 shows the antenna after the addition of a second resonator that is a second radiating surface.
Figure 13A:
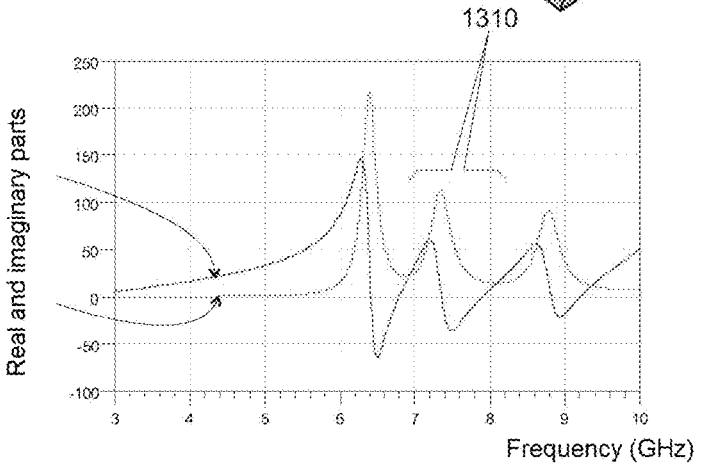
FIGS. 13*a* and 13*b* illustrate the effect of the second radiating surface on the operation of the antenna.
Figure 13B:
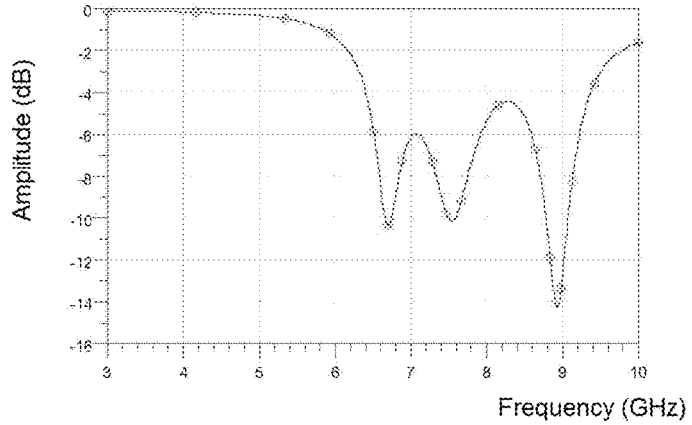

FIGS. 12, 13*a* and 13*b* illustrate a third step of the invention where a second resonator is installed in the form of a second radiating surface 312. Installed next to the first radiating surface 318, the second radiating surface 312 is excited by capacitive coupling with the first radiating surface 318. Preferably, the first radiating surface 318 and the second radiating surface 312 are connected at the level of the same side wall 316. The first and second radiating surfaces 318, 312 are advantageously free of vibration from each other in the three spatial directions. The side wall 316 is connected to a coupling trace 416 located on a second face of the substrate 410, opposite to the first face of the substrate 410, and the side wall 316 and the coupling trace 416 being configured to act as capacitive coupling between at the first radiating surface 318, the second radiating surface 312 and the ground plane.

FIGS. 13*a* and 13*b* illustrate the frequency behavior of the antenna 310 comprising the first radiating surface 318 and second radiating surface 312. It can thus be seen the presence of three modes of resonance, which correspond to two resonances of the first radiating surface 318 already seen plus a resonance 1310 of the second radiating surface 312. The third resonance corresponds to a mode of λ/4 along a length dimension 1210 of the additional resonator that is to say of the second radiating surface 312.

Figure 14:
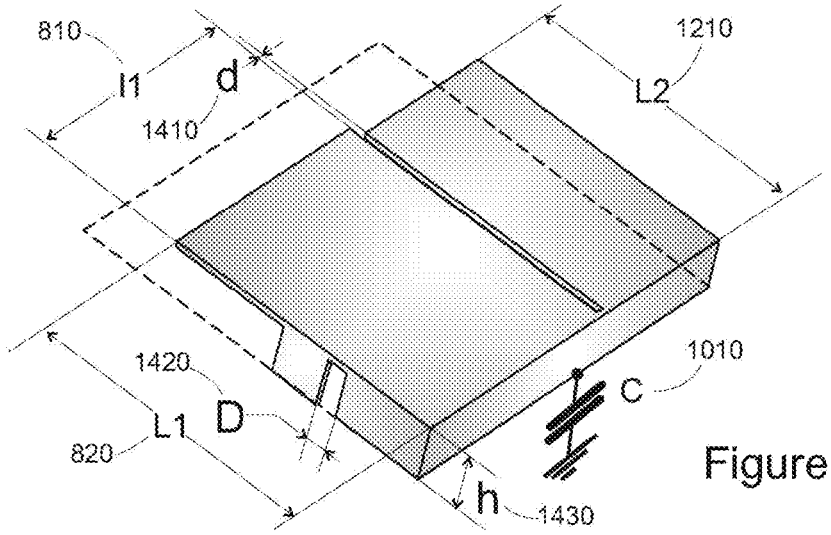
FIG. 14 shows the adjustable parameters of the antenna.

FIG. 14 illustrates the parameters of the antenna 310, which are adjustable thus allowing varying the resonance frequencies and obtaining an efficient coupling between the three modes. In particular, the operation of the antenna in broadband is made possible by the coupling of several resonances due to the presence of several radiating surfaces 312, 318 coupled to one another and to the adjustments of parameters mentioned below:

The length (L1) and the width (I1) of the first radiating surface 318, respectively: 820 and 810;

The length (L2) of the second radiating surface 312: 1210;

The value (C) of the coupling capacitor: 1010;

The spacing (d): 1410 between the first radiating surface 318 and the second radiating surface 312;

The distance (D): 1420 between the side tongue of power supply 314 and the side wall 316;

The height (h): 1430 of the antenna 310; and

The dielectric constants (ε) of the materials used.

According to one preferred embodiment, the first radiating surface 318 has a length dimension 820 larger than the length 1210 of the second radiating surface 312.

Figure 15A:
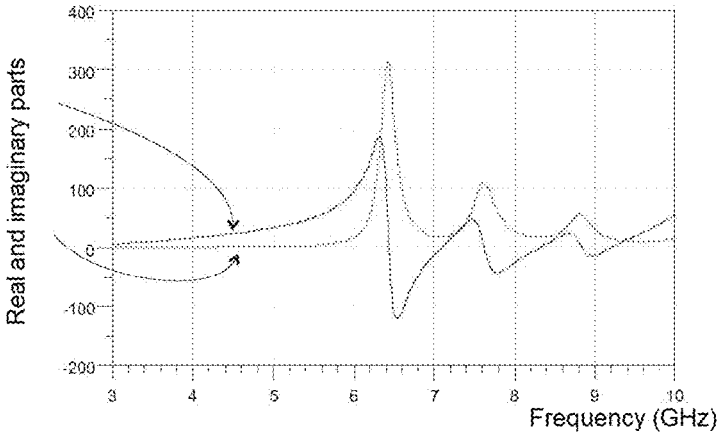
FIGS. 15*a* and 15*b* illustrate the operation of an antenna according to the invention, the parameters of which have been adjusted to cover the frequency band ranging from 7 to 9 GHz.
Figure 15B:
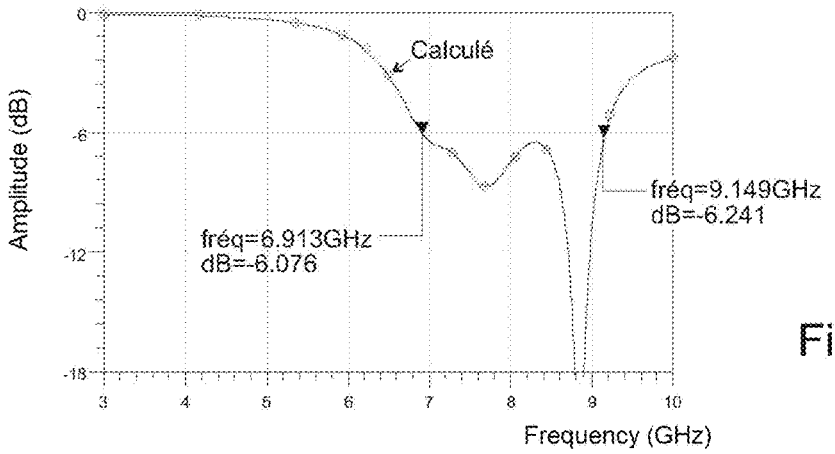

FIGS. 15*a* and 15*b* show the results obtained with an UWB antenna which have been developed according the above principles for operating in the frequency band ranging from 7 to 9 GHz. In order to be able to integrate the antenna 310 in an AIP module, parameters such as the height 1430, the length 820 and the width 810 each of which have been fixed to a maximum dimension so that the external dimension of the module stay compatible with the objectives of miniaturization established by the market and particularly, as seen, its thickness.

The dielectric materials used and that of the substrate 410 are also based on the use of standard materials in order to maintain a manufacturing cost as low as possible.

A study on the different adjustable parameters mentioned above thus allows obtaining an antenna 310 operating in the frequency band ranging from 7 to 9 GHz and integrated in an AIP module whose dimensions involved in this example being parallelepiped whose base is a square of side of 7 mm and of a thickness of 1.5 mm. Translated in wavelength of central frequency of the frequency band under consideration, that is to say 8 GHz, which corresponds to a wavelength λ in the vacuum of 37.5 mm, this specific example of an antenna 310 according to the invention has dimensions of the order of λ/5 with respect to horizontal dimensions (side of the square) and of λ/25 in height.

FIGS. 15*a* and 15*b* bring to light the good behavior of the antenna 310 where the multiple resonance properly coupled allow obtaining a broadband antenna 310 of the order of 2 GHz at −6 dB, which represents 25% of the central frequency. This band covers all the channels of Group 6 of the frequency range of the UWB standard.

Figure 16A:
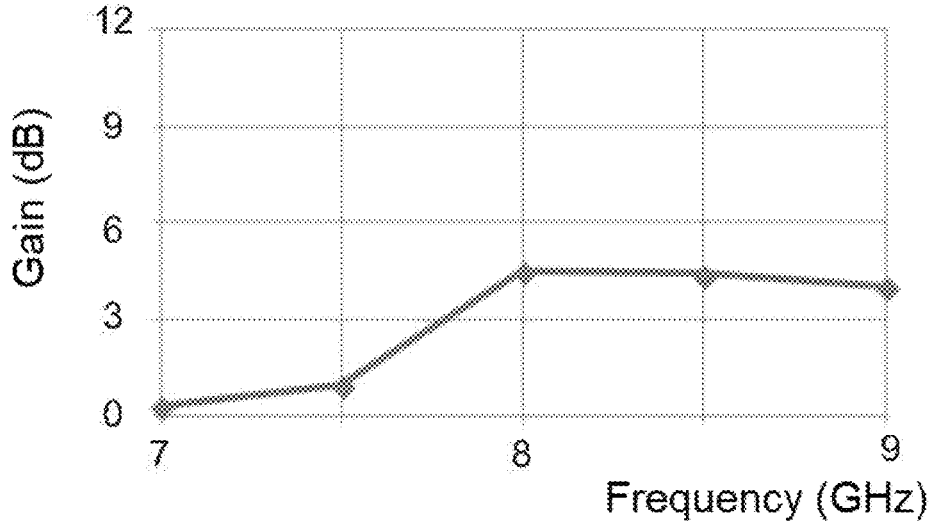
FIGS. 16*a* and 16*b* give the gain and the efficiency of the antenna corresponding to FIGS. 15*a* and 15*b*.
Figure 16B:
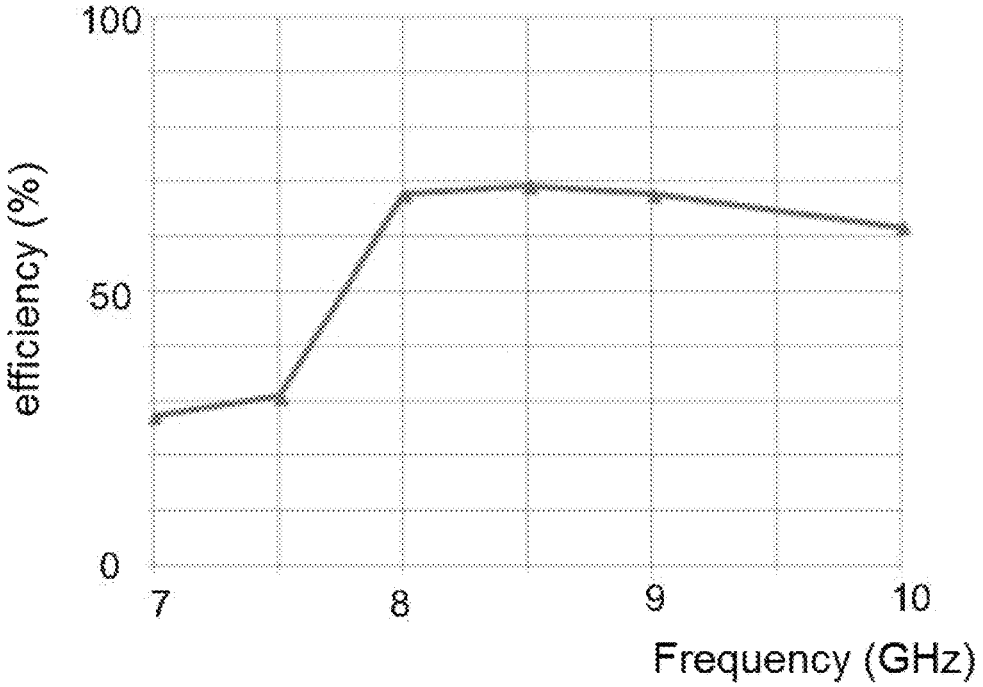

FIGS. 16*a* and 16*b* illustrate the radiation performances of the antenna 310 which are expressed respectively in terms of gain and efficiency. These results show that the antenna 310 performs well in the entire frequency band for which it has been designed, not only in terms of its impedance matching as seen in the above drawings, but also presents a good behavior in terms of radiated power expressed on the one hand by its gain in dB (FIG. 16*a*) and on the other hand by its efficiency in percentage of the injected power.

Figure 17A:
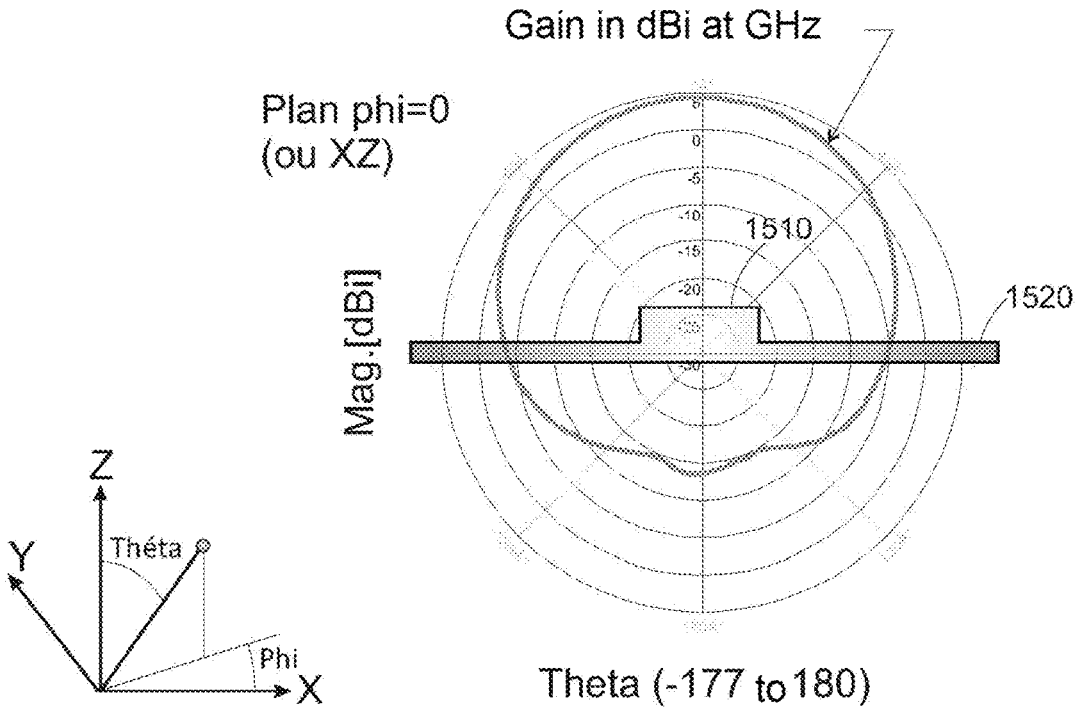
FIGS. 17*a* and 17*b* show the diagram of the radiation of the antenna corresponding to FIGS. 15*a* and 15*b*.
Figure 17B:
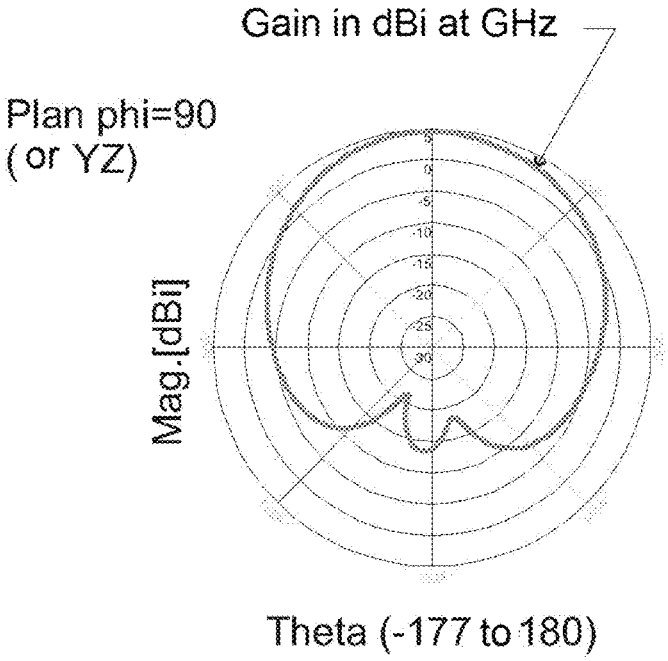

FIGS. 17*a* and 17*b* show the diagrams of radiation calculated of the antenna 310 in two perpendicular directions (Phi=0 and Phi=90) when it is contained in an AIP module 1510 itself placed on an application PCB 1520 comprising a ground plane of mobile phone type. It is clear that the antenna 310 radiates as expected in a homogeneous way in the upper half-space over the PCB.

Figure 18:
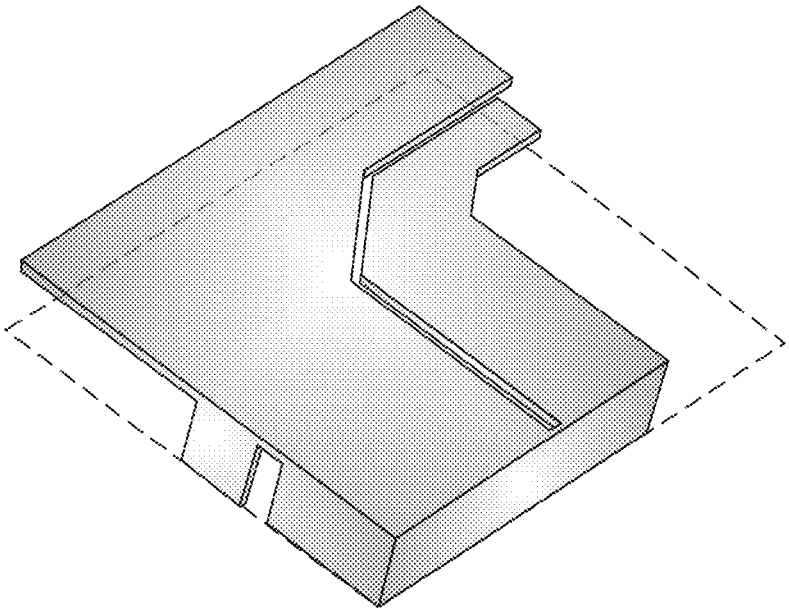
FIG. 18 is an example of an antenna according to the invention made of non-rectangular surface.

FIG. 18 illustrates the fact that an antenna 310 according to the invention can also be well composed of the first radiating surface 318 and the second radiating surface 312 which are not only of rectangular or polygonal shape. All kinds of shapes other those studied are likely to suit all while maintaining the same operating principle and the associated advantages. FIG. 18 is an examples of more complicated shapes which have been studied and which give results that are as good as those returned in the above drawings concerning exclusively the rectangular-shaped radiating surfaces 312, 318. According to this embodiment, at least the first radiating surface (318) forms an L of which a first side of the L extends along the length (820) of the first radiating surface (318) and a second side of the L extending along the width (810) of the first radiating surface (318). The first side of the L and the second side of the L advantageously form an angle of 90°. A bend is formed at the intersection between the first side of the L and the second side of the L. The second radiating surface 312 is preferably an homothety of the first radiating surface 318 whose dimensions of length and width are smaller.

The present invention is not limited to the embodiments described above and but extends to any embodiments within its spirit.

The invention claimed is:

1. An apparatus for transmitting and/or receiving radiofrequency signals comprising at least a broadband antenna and a substrate; the antenna comprising at least a first radiating surface and being superimposed on the ground plane, the ground plane being located on a first face of the substrate, at least a side tongue of a power supply and at least a side wall connected to at least the first radiating surface, wherein:

the antenna comprises at least a second radiating surface excitable by coupling with the first radiating surface, the side wall is connected to a coupling trace located on a second face of the substrate, the second face opposite to the first face of the substrate, and the side wall and the coupling trace being configured to act as a capacitive coupling between at least the first radiating surface, the second radiating surface and the ground plane, and wherein the coupling trace is configured to form a coupling capacitor whose value is $\varepsilon S/e$ where $\varepsilon$ is the dielectric constant of the dielectric material constituting the substrate. S is the surface of the coupling trace and e is the thickness between the coupling trace located on the second face of the substrate and the ground plane located on the first face of the substrate, and wherein the first face of the substrate is a lower surface of the substrate and the second surface of the substrate is a surface of the substrate above the first face.

2. The apparatus according to claim 1, wherein the antenna is configured to generate at least a first resonance along a length dimension of the first radiating surface and at least a second resonance along a width dimension of the first radiating surface.

3. The apparatus according to claim 1, wherein the side wall comprises at least a first portion in a plan parallel to the thickness of the substrate and along a width dimension of the first radiating surface.

4. The apparatus according to claim 1, wherein the side wall comprises at least a second portion in a plane parallel to the thickness of the substrate and along a length dimension of the first radiating surface.

5. The apparatus according to claim 3, wherein the first portion and the second portion of the side wall are configured to be in electrical contact and are fixed onto the coupling trace.

6. The apparatus according to claim 1, wherein the antenna is configured to generate a third resonance along a length dimension of the second radiating surface.

7. The apparatus according to claim 6, wherein the first radiating surface has a length dimension larger than the length dimension of the second radiating surface.

8. The apparatus according to claim 1, wherein the first radiating surface and the second radiating surface are of rectangular or polygonal shape.

9. The apparatus according to claim 1, wherein at least the first radiating surface forms an L with a first side of the L extending along the length dimension of the first radiating surface and a second side of the L extending along the width dimension of the first radiating surface.

10. The apparatus according to claim 1, wherein the second radiating surface is a homothety of the first radiating surface of smaller dimension.

11. The apparatus according to claim 1, wherein the side tongue of power supply is configured to be in contact with a power supply trace located on the second face of the substrate.

12. The apparatus according to claim 11, wherein the antenna forms a cavity for accommodating at least a chip between at least the first radiating surface and the second face of the substrate.

13. The apparatus according to claim 12, wherein the power supply trace is connected to a connection of the chip.

14. The apparatus of claim 1, wherein the antenna comprises a folded metal plate.

15. The apparatus of claim 1, further comprising an overmolding configured to coat at least the antenna.

16. The apparatus of claim 15, comprising at least one chip located on the second face of the substrate, wherein said at least on chip is overmolded.

17. The apparatus of claim 1, wherein the first face of the substrate is a first surface of the substrate and the second face of the substrate is a second surface of the substrate.

18. An apparatus for transmitting and/or receiving radiofrequency signals comprising at least a broadband antenna and a substrate; the antenna comprising at least a first radiating surface and being superimposed on the ground plane, the ground plane being located on a first face of the substrate, at least a side tongue of a power supply and at least a side wall connected to at least the first radiating surface, wherein:

the antenna comprises at least a second radiating surface excitable by coupling with the first radiating surface, the side wall is connected to a coupling trace located on a second face of the substrate, the second face opposite to the first face of the substrate, and the side wall and the coupling trace being configured to act as a capacitive coupling between at least the first radiating surface, the second radiating surface and the ground plane, and wherein the coupling trace is configured to form a coupling capacitor whose value is $\varepsilon S/e$ where $\varepsilon$ is the dielectric constant of the dielectric material constituting the substrate. S is the surface of the coupling trace and e is the thickness between the coupling trace located on the second face of the substrate and the ground plane located on the first face of the substrate, wherein the second face of the substrate is a top surface of the substrate and the first surface of the substrate is a surface of the substrate below the second face.

* * * * *